United States Patent [19]

Eberly, Jr. et al.

[11] Patent Number: 4,464,252

[45] Date of Patent: Aug. 7, 1984

[54] ADSORBENTS FOR SULFUR REMOVAL

[75] Inventors: Paul E. Eberly, Jr.; William E. Winter, Jr., both of Baton Rouge, La.

[73] Assignee: Exxon Research & Engineering Co., Florham Park, N.J.

[21] Appl. No.: 410,250

[22] Filed: Aug. 23, 1982

[51] Int. Cl.[3] ..... C10G 29/04

[52] U.S. Cl. ..... 208/243; 208/244; 208/249; 208/251 R; 502/34; 502/38

[58] Field of Search ..... 208/243, 249, 251 R; 252/411 S; 423/244; 502/38

[56] References Cited

U.S. PATENT DOCUMENTS 3,454,356 7/1969 Raman ..... 423/244 R
3,495,941 2/1970 Van Helden ..... 423/244 R
4,008,174 2/1977 Jacobson et al. ..... 252/411 S
4,371,728 2/1983 Farha, Jr. et al. ..... 252/411 S

*Primary Examiner*—Delbert E. Gantz
*Assistant Examiner*—Anthony McFarlane
*Attorney, Agent, or Firm*—Llewellyn A. Proctor

[57] ABSTRACT

A process wherein a regenerated, spent sulfided vanadium-containing Group VIII metal, Group VI-B metal, or Group VI-B/Group VIII metals containing catalyst is contacted with a stream of an oxygen-containing gas and the coke burned therefrom to regenerate the catalyst. The regenerated catalyst as such, or after reduction of the catalytic metals by contact with hydrogen, can be used as an adsorbent to remove essentially all of the sulfur from a naphtha feed which contains as much as 50 weight ppm sulfur, and greater.

6 Claims, No Drawings

ADSORBENTS FOR SULFUR REMOVAL

FIELD OF THE INVENTION

This invention relates to a process for the desulfurization of hydrocarbon feedstocks, particularly the desulfurization of naphtha feeds with vanadium and nickel or cobalt containing adsorbents.

BACKGROUND OF THE INVENTION AND PRIOR ART

The use of catalysts formed by supporting Group VIII non-noble metals and Group VI-B metals (Periodic Table of the Elements, E. H. Sargent & Company; Copyright 1962 Dyna-Slide Co.), e.g., Ni/Mo, Co/Mo, Ni/Co/Mo, Ni/W, Co/W, Ni/Co/W and the like upon porous refractory inorganic oxides, particularly alumina, to catalytically remove sulfur from petroleum fractions, crude oils, and other mixtures of hydrocarbons has been known for many years. Sulfur removal is necessary since its presence in appreciable amounts gives rise to serious corrosion and refining problems. In many refinery processes, especially those using catalysts, feed sulfur is very deleterious in that it causes excessive catalyst deactivation and loss of yield of the desired product. Gasoline should be relatively free of sulfur to make it compatible with lead anti-knock compounds, and to improve its color and odor stability. In particular, in reforming (hydroforming) processes used to make high octane gasoline, sulfur compounds, even in the 1–20 parts per million, (wppm) range contribute to loss of catalyst activity and $C_5$+ liquid yield. In the last decade, in particular, polymetallic metal catalysts have been employed to provide, at reforming conditions, improved catalyst activity, selectivity and stability. Thus, additional metallic components have been added to the more conventional platinum catalysts as promotors to further improve, particularly, the activity or selectivity, or both, of the basic platinum catalyst, e.g., iridium, rhenium, selenium, tin, and the like. In the use of these catalysts it has become essential to reduce the feed sulfur to only a few wppm. For example, in the use of platinum-rhenium catalysts it is generally necessary to reduce the sulfur concentration of the feed well below about 2 wppm, and preferably well below about 0.1 wppm, to avoid excessive loss of catalyst activity and $C_5$+ liquid yield. By removing virtually the last traces of sulfur from the naphtha feed, considerable improvement in activity and $C_5$+ liquid yield of high octane product are achieved. Stability advantages also occur enabling longer catalyst life and run length to be realized.

The sulfur-containing feed, prior to reforming, is generally treated over a hydrofining catalyst, e.g., a Co/Mo catalyst, and major amounts of the sulfur are catalytically removed in the form of hydrogen sulfide, $H_2S$. However, due to the presence of small amounts of olefins, it is possible for some of the $H_2S$ to recombine with the olefins upon cooling and to form trace amounts of undersirable sulfur compounds predominantly in the form of mercaptans. This trace residual sulfur can then be removed from the naphtha reformer feed by adsorption over copper chromite or catalysts containing nickel. These metals have been found useful per se, or have been supported on high surface area refractory inorganic oxide materials such as alumina, silica, silica/alumina, clays, kieselguhr, and the like. For example, a massive nickel catalyst containing 50–60% nickel on kieselguhr has been used. Such catalysts become sulfur saturated, and in the present state-of-the-art are not generally regenerated, but discarded or processed for metals recovery.

The earlier mentioned Group VI-B/VIII catalysts have thus conventionally been used to hydroprocess, or hydrodesulfurize, various hydrocarbon fractions to catalytically remove not only sulfur, but also nitrogen, from the hydrocarbon fractions. In hydroprocessing such feeds as vacuum gas oils, atmospheric or vacuum residua, shale, coal liquid fractions and the like, however, not only is sulfur removed from the feed, but also nickel and vanadium. As a result, these metals together with sulfur, carbonaceous material, or coke, and other materials are deposited on the catalysts gradually rendering them inactive. Thus, the catalyst not only contains its original metals, but additionally nickel and vanadium. After extended use, the catalyst becomes sufficiently inactive that it is no longer suitable for use in commercial operation, and hence it must be replaced. It has little value, and in conventional practice it is replaced by a fresh catalyst.

THE INVENTION

In accordance with the present invention, a spent Group VI-B and/or Group VIII metal containing catalyst having had deposited on it, by virtue of its use, coke, sulfur and/or additional nickel and vanadium is regenerated by contact with a stream of an oxygen-containing gas, preferably air, or air/inert mixture, or oxygen-enriched air and the coke burned therefrom, such regeneration converting the metals to their oxides, and perhaps to some extent to their sulfates. The regenerated catalyst as such, or after reduction of the catalytic metals by contact with hydrogen, can be used as an absorbent to remove essentially all of the sulfur from a naphtha feed which contains as much as 50 wppm sulfur or greater.

A bed of the regenerated vanadium-containing Group VI-B, Group VIII, or Groups VI-B/VIII metals catalyst is contacted with a naphtha feed containing generally from about 1 wppm to about 50 wppm, preferably from about 1 wppm to about 10 wppm sulfur. The feed is passed therethrough to remove sufficient of the sulfur-containing compounds from the feed to provide a sulfur level in the product of 0.2 wppm, or less; and preferably, 0.1 wppm, or less. Suitably, the bed of spent catalyst is contacted with the naphtha at temperatures ranging from about 100° F. to about 600° F., preferably from about 300° F. to about 500° F., at pressures ranging from about atmospheric to about 600 psig, preferably from about 100 psig to about 400 psig, and at space velocities ranging from about 0.1 V/V/Hr to about 30 V/V/Hr, preferably from about 1 V/V/Hr to about 20 V/V/Hr. The desulfurization of the naphtha feed is accomplished either in the absence or presence of added hydrogen. Preferably, hydrogen is not used. However, some hydrogen can be employed sufficient to saturate the hydrocarbon liquid at the temperature and pressure of the adsorption unit. Or it can be added to the extent of 1 to 200 SCF/B. Contact of the sulfur-containing feed with the bed of catalyst is continued to the point of breakthrough of sulfur in the exit effluent from the bed. In the preferred case, breakthrough is characterized by a sulfur content in the exit stream significantly exceeding 0.1 wppm S.

The invention, and its principle of operation, will be more fully understood by reference to the following examples and comparative data.

EXAMPLE

Two catalysts, designated Catalysts A and B, were obtained form catalyst manufacturers. Catalyst A is a nickel-containing material consisting of 73% Ni expressed as the oxide admixed or impregnated upon kieselguhr, otherwise known as diatomaceous earth, a naturally occurring form of silica. Catalyst B, is a standard Ni/Mo catalyst used for the catalytic desulfurization of petroleum and other hydrocarbonaceous streams. Catalyst C, is a spent hydrodesulfurization catalyst originally consisting of Ni and Mo supported on alumina. Prior to regeneration, this catalyst contained 13.41% carbon and 5.95% sulfur by weight. The catalyst was regenerated by contacting with an oxygen/nitrogen mixture and burning off the coke and sulfur at 600° F.–800° F. over a period of 24 hours. After regeneration, the carbon and sulfur contents were 0.1% and 2.13%, respectively. An analysis of each catalyst is given in Table I.

TABLE I

| % by Weight | Catalyst A | Catalyst B | Catalyst C |
|---|---|---|---|
| NiO | 73 | 5.5 | 6.3 |
| $SiO_2$ | 27 | — | 0.0 |
| $Al_2O_3$ | 0 | 81.9 | 77.1 |
| $MoO_3$ | 0 | 12.6 | 10.4 |
| $V_2O_5$ | 0 | 0 | 6.3 |

To test these catalysts, each was reduced at 700° F. with atmospheric hydrogen, and then a 5 gram portion thereof was placed in an autoclave. An amount of 580 ml of a naphtha containing 2500 wppm S as n-hexylmercaptan was then added. The autoclave was then pressurized with hydrogen to 275 psig and heated to 350° F. with vigorous stirring. After contacting each catalyst for 16 hours, a sample of liquid was withdrawn and analyzed for sulfur content. From the reduction in sulfur content, the amount of sulfur retention on the catalyst was determined. Results using Catalysts A, B, and C are listed in Table II.

TABLE II

| AUTOCLAVE EXPERIMENT | | |
|---|---|---|
| Charge: | 580 ml of Arabian Naphtha Spiked with n-Hexyl Mercaptan to Contain 2500 wppm S | |
| Catalyst: | 5 Grams of 60–80 Mesh Particles | |
| Conditions: | 350° F., 275 psig, 16 hr Contact Time | |
| Catalyst | Wt. % S | S/Ni Atomic Ratio |
| A | 22.5 | 0.928 |
| B | 6.5 | 2.95 |
| C | 10.9 | 4.53 |

These data show that Catalyst A adsorbs the most sulfur. This is not completely unexpected since the material contains 73% Ni as expressed in the form of NiO. The sulfur uptake corresponds to 0.928 atoms S/atom Ni. The Ni/Mo catalyst, on the other hand, is able to adsorb 6.5% sulfur by weight, corresponding to 2.95 atoms S/atom Ni. However, it is quite possible that the molybdenum is also capable of combining, and hence may in fact combine with the sulfur compound. In any event however, the significance underlying this invention is best seen by the performance of catalyst C. This material adsorbs 10.9% sulfur, which corresponds to 4.53 atoms S/atoms Ni, although here again the Mo as well as the V compounds may be absorbing sulfur, it is quite clear that the presence of the vanadium enhances sulfur adsorption.

Thus, vanadium addition is beneficial for improving the sulfur retention of the Ni/Mo catalyst. Such a catalyst is very cheaply obtained as a discharged hydrofining catalyst or catalyst used for residual conversions.

It is apparent that various modifications and changes can be made without departing the spirit and scope of the invention.

Having described the invention, what is claimed is:

1. A process for the removal of sulfur from a sulfur-containing hydrocarbon feed which comprises contacting said sulfur-containing hydrocarbon feed with a bed of spent regenerated hydrofining catalyst consisting essentially of vanadium and a Group VIII metal, or a Group VI-B metal, or both Group VI-B/Group VIII metals deposited on a support, said support comprising alumina.

2. The process of claim 1 wherein, prior to contact of the sulfur containing hydrocarbon feed with said bed of catalyst, the catalyst is used in a hydroprocessing reactor wherein coke and metals are deposited, said coked catalyst is then regenerated by contact with a stream of an oxygen-containing gas, and the coke burned therefrom.

3. The process of claim 2 wherein the catalyst, after the coke is burned therefrom, is reduced by contact with hydrogen.

4. The process of claim 1 wherein the regenerated vanadium-containing Group VI-B, Group VIII, or Groups VI-B/VIII metals catalyst is contacted with a naphtha feed containing generally from about 1 wppm to about 50 wppm sulfur.

5. The process of claim 4 wherein the feed contains from about 1 wppm to about 10 wppm sulfur and the feed passed therethrough removes sufficient of the sulfur-containing compounds from the feed to provide a sulfur level in the product of 0.2 wppm, or less.

6. The process of claim 1 wherein the sulfur-containing hydrocarbon feed is a naphtha, and the bed of spent, regenerated catalyst is contacted with the naphtha at temperatures ranging from about 100° F. to about 600° F., at pressures ranging from about atmospheric to about 600 psig, and at space velocities ranging from about 0.1 V/V/Hr to about 30 V/V/Hr.

* * * * *